United States Patent [19]

Loudon

[11] 4,455,938

[45] Jun. 26, 1984

[54] DAMPENING APPARATUS FOR LITHOGRAPHIC PRESS

[75] Inventor: James R. Loudon, Toledo, Ohio

[73] Assignee: Graph Tech Inc., Oakland, N.J.

[21] Appl. No.: 464,802

[22] Filed: Feb. 7, 1983

Related U.S. Application Data

[63] Continuation-in-part of Ser. No. 294,925, Aug. 21, 1981, abandoned, and Ser. No. 183,751, Sep. 12, 1980, abandoned, each is a continuation-in-part of Ser. No. 41,527, May 22, 1979, abandoned.

[51] Int. Cl.[3] ..... B41F 31/06; B41F 31/10; B41L 27/08

[52] U.S. Cl. ..... 101/148; 101/363

[58] Field of Search ..... 101/364, 350, 363, 147, 101/148, 351, 352, 204, 207, 208, 210, 340, 344, 347, 355, 356, 360; 222/585, 586, 587, 588, 589; 118/259, 260, 261

[56] References Cited

U.S. PATENT DOCUMENTS

| | | | |
|---|---|---|---|
| 382,698 | 5/1888 | Garland | 222/586 |
| 1,811,745 | 6/1931 | Clary | 222/587 |
| 2,177,772 | 10/1939 | Gregory | 222/586 |
| 2,637,336 | 5/1953 | Emery | 101/148 X |
| 3,145,653 | 8/1964 | Lake | 101/364 |
| 3,769,909 | 11/1973 | Fugman et al. | 101/363 X |

FOREIGN PATENT DOCUMENTS

| | | | |
|---|---|---|---|
| 707759 | 7/1941 | Fed. Rep. of Germany | 101/364 |

*Primary Examiner*—J. Reed Fisher

*Attorney, Agent, or Firm*—Biebel, French & Nauman

[57] ABSTRACT

The present invention relates to a dampening apparatus for lithographic offset printing presses. A form roller having an ink receptive compressible surface is pressed against a plate on the plate cylinder, and a metering means lying parallel and tangent to the form roller having a relatively incompressible ink receptive surface is pressed against the form roller. A reservoir of dampening solution is maintained above the nip of the form roller and metering roller, and is automatically maintained. Rotation of the form roller results in a metered quantity of solution being fed to the form roller, a portion of that quantity being applied to the lithographic plate, and the excess of that quantity being returned to the supply. The ink applied to the plate is allowed to transfer to both dampener rollers, and the action of the rotating rollers, forced together, on the ink-solution mixture or emulsion, mills that emulsion into essentially uniform small particles which result in quick, thorough, and uniform inking and dampening of the plate.

14 Claims, 19 Drawing Figures

FIG. 12
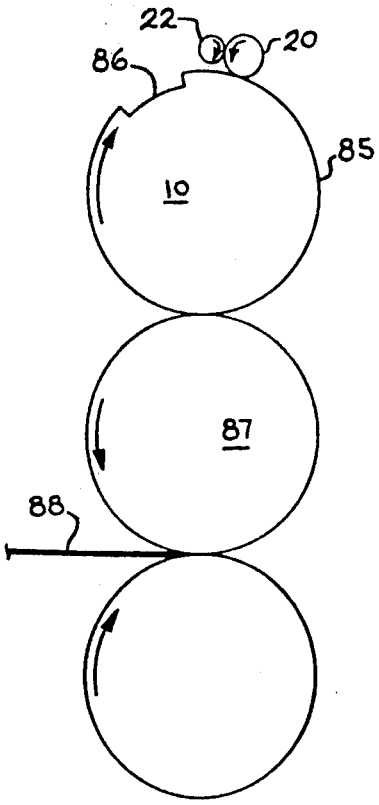
FIG. 13
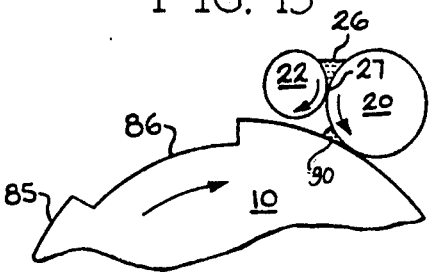
FIG. 14
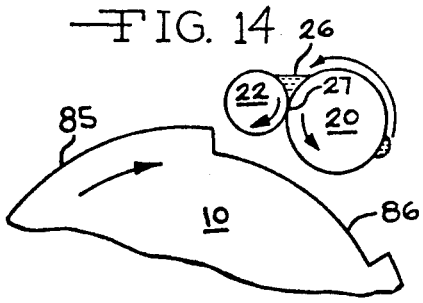
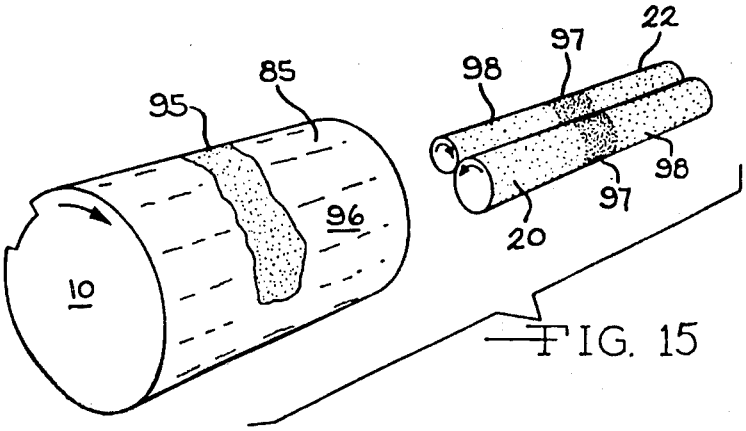
FIG. 15

DAMPENING APPARATUS FOR LITHOGRAPHIC PRESS

CROSS-REFERENCE TO RELATED APPLICATIONS

This application is a continuation-in-part of application Ser. No. 294,925 filed Aug. 21, 1981, now abandoned, and application Ser. No. 183,751 filed Sept. 12, 1980, now abandoned, both of which are in turn a continuation-in-part of application Ser. No. 041,527 filed May 22, 1979, now abandoned, entitled DAMPENING FEED APPARATUS.

BACKGROUND OF THE INVENTION

The present invention relates to dampening systems for offset lithographic printing presses.

The major components of the offset press are the plate cylinder, blanket cylinder, dampening system, and inking system. Secured around the plate cylinder is a planographic printing plate upon which is imposed an image defined by a gradation of oleophilic dots and a hydrophilic background, the intensity of the image being directly proportional to the concentration of such dots.

The function of the dampening system is to thoroughly moisten only the background of the plate with a substantially aqueous solution. Grease-based ink is applied to the plate and adhers only to the oleophilic dots to create an inked image which is transferred to an adjacent blanket cylinder and subsequently to the paper to be printed. The most common dampening devices used in offset lithographic presses are either of the type disclosed in Dahlgren U.S. Pat. No. 4,088,074 issued May 9, 1978, or of the oscillating ductor roller type which has been used in this art for many years.

The dampening system is a critical element of the press. If the quantity and application of the dampening solution is not precise, the solution and ink will incorrectly coat the respective hydrophilic and oleophilic areas, and the finally printed image will be distorted. Conventional ductor roller dampening systems control the amount of solution transferred to the form roller, which contacts the plate cylinder, by adjusting the rate of oscillations of the ductor roller which reciprocates back and forth from a solution reservoir to the train of dampening rollers. The amount of solution which is then actually transferred to the plate is controlled by adjusting the pressure between the form roller and the plate cylinder. Excess solution is nipped between the form roller and the plate cylinder and accumulates on the form roller. This excess solution must eventually be reduced by decreasing the number of oscillations of the ductor roller, or it will accumulate enough to result in over-moistening of the printing plate.

Additionally, in order to absorb a sufficient quantity of dampening solution for subsequent application to the printing plate, the form rollers are covered with a highly absorptive material such as a molleton. The covers, however, ultimately become fouled with ink which collects and finally prevents moistening solution from transferring to the background areas of the printing plate, until such covers are replaced. As a result of these and other disadvantages of prior art dampening systems, sharply defined prints are difficult to obtain without a great deal of control and attention.

SUMMARY OF THE INVENTION

The present invention is a dampening solution feed apparatus for offset lithographic printing presses which addresses and solves the problems of the prior art dampening systems. In a preferred embodiment, the apparatus includes a first or form roller lying parallel and tangent to the plate cylinder, a second or metering roller lying parallel and tangent to the downwardly rotating side of the form roller, a reservoir of dampening solution lying above and between the form and metering rollers, and means for regularly supplying solution to the reservoir to maintain the reservoir level.

By means of the above-described system then, an excessive amount of dampening solution is always in contact with the form roller. The amount of solution actually applied is controlled by adjusting the pressure between the form and metering rollers and between the form roller and the plate cylinder. Excess moisture which is retained on the form roller then is continuously returned directly to the reservoir. Similarly, since conventional plate cylinders include a recessed clamping section or gap for mounting the printing plates, excess solution which collects between the cylinder and the form roller is also returned directly to the reservoir upon each pass of the recessed section. Thus, the solution cannot accumulate anywhere and eventually overdampen the plate.

Also, since the reservoir is in direct contact with the form roller, it does not need an absorptive molleton cover to transfer adequate solution. Thus, with the present invention, there are no such covers to get fouled with ink, and to be timely replaced.

The form roller has a surface which is compressible and ink receptive, and the metering roller has a surface which is much more rigid than the form roller (e.g. metal) and which is also ink receptive. In operation no attempt is made to prevent or minimize the transfer of ink from the inked plate onto the dampening form roller and metering roller. Instead, contrary to the accepted practice, no effort is made to avoid such ink transfer into the dampener, and upon commencing a printing operation the liquid in the reservoir quickly becomes an emulsion of ink and dampening solution. The form roller is positively driven from the plate cylinder, and the metering roller is driven from the form roller. Thus, the surface velocity of the metering and form rollers, and of a plate on the plate cylinder, are the same.

It is, therefore, the primary object of the present invention to provide a new dampening apparatus for offset printing presses incorporating the aforementioned features; to improve the control over the dampening process in an offset printing press while minimizing makeready time; and thereby to increase the efficiency of offset printing presses.

Other objects and advantages of the present invention will be obvious to persons skilled in the art in view of the following detailed description.

BRIEF DESCRIPTION OF THE DRAWINGS

FIG. 12 is a schematic view of the printing cylinders and the dampening rollers of the preferred embodiment in FIG. 1;

FIGS. 13 and 14 are schematic views of the dampening rollers and the plate cylinder illustrating the cyclic return of excess solution back to the reservoir;

FIG. 15 is a pictorial representation of the plate cylinder and the dampening rollers of the preferred embodiment in FIG. 1 after a period of printing;

DESCRIPTION OF THE PREFERRED EMBODIMENT

Figure 1:
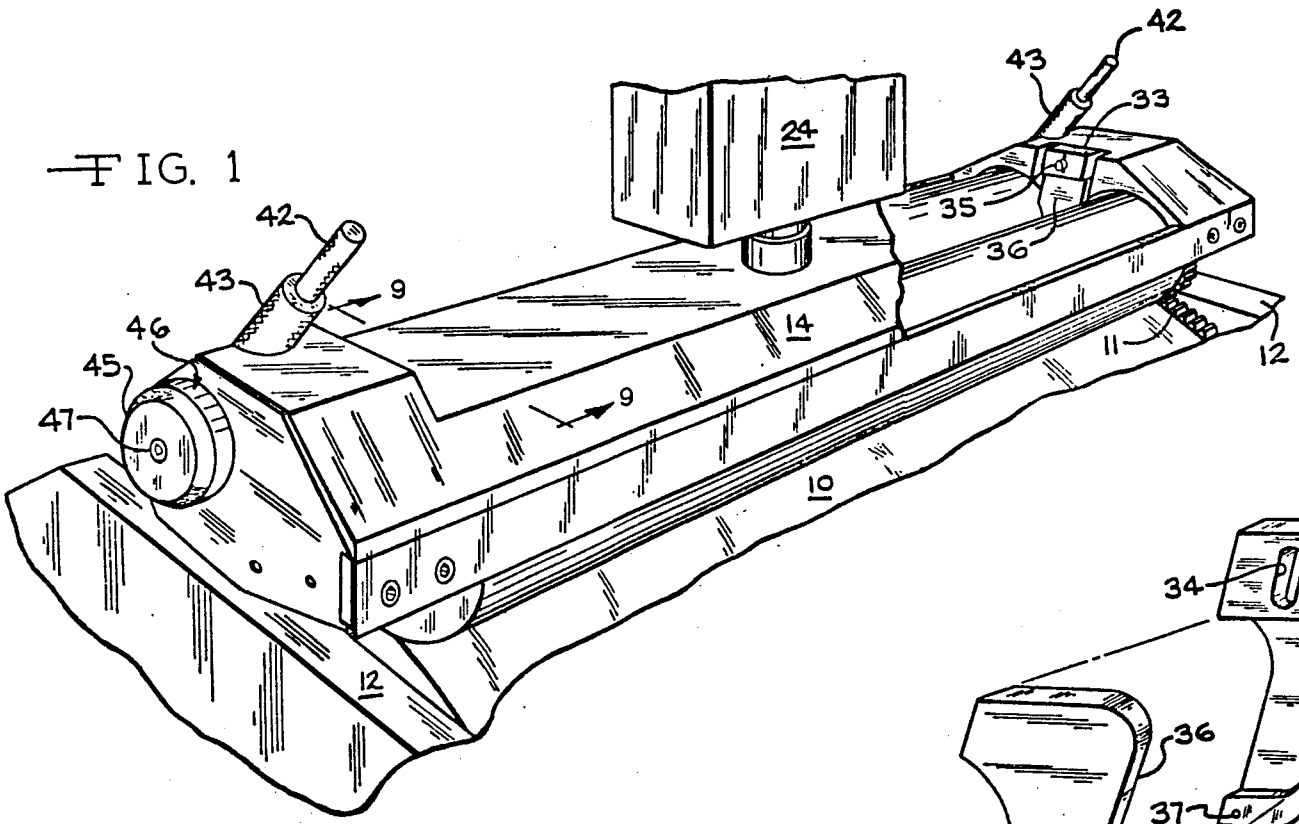
FIG. 1 is a cutaway pictorial view of the preferred embodiment of the dampening apparatus of the present invention.

FIG. 1 depicts a preferred embodiment of the dampening apparatus. The press includes a plate cylinder 10 driven by a drive gear 11 within a framework 12. The dampening apparatus itself is enclosed within a frame including end housings 13 and a cover 14, part of which is broken away. The dampening apparatus is attached to the press housing in a conventional manner, later described in connection with FIG. 11. Pressure between the plate cylinder 10 and a form roller 20 is adjusted through the attachment.

Figure 10:
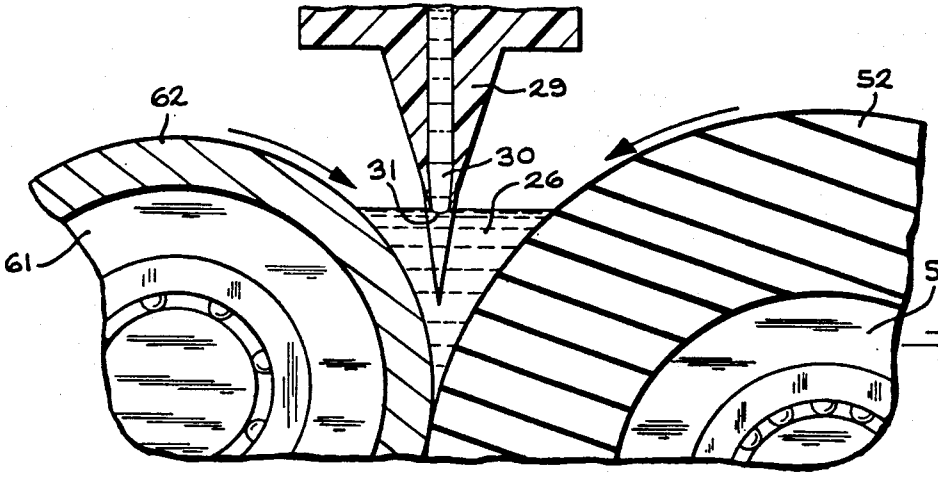
FIG. 10 is an enlarged sectional view of a portion of FIG. 8.

The dampening apparatus includes a compressible form roller 20 mounted parallel and contiguous to the plate cylinder 10, the second or metering roller 22 lying parallel and tangent to the form roller 20, a reservoir 26 of dampening solution (shown in FIGS. 10, 13, 14) located between the form roller 20 and metering roller 22 and above their line of tangency 27, and a solution supply fountain bottle 24 positioned immediately above the reservoir 26.

Figure 9:
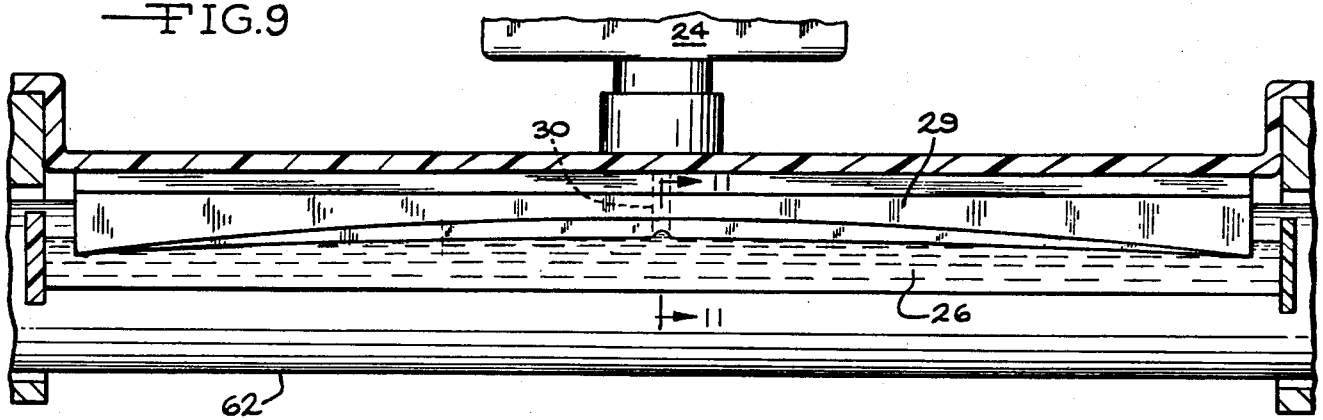
FIG. 9 is a sectional view along line 9—9 in FIG. 8.

The solution fountain bottle 24 is a closed container having a wick or distributor 29 which extends horizontally in an arcuate shape almost the entire length of the second roller as shown in FIG. 9. The solution is discharged through an outlet 30 located approximately midway along the length of the wick. By that arrangement, as the level of the reservoir 26 drops below a boundary 31 of the outlet 30, air enters the bottle 24 and allows solution therein to discharge until the level of the reservoir 26 again completely covers the boundary 31 of the outlet 30. Thus, the solution fountain bottle 24 serves automatically to maintain the reservoir 26 at a predetermined level. The boundary of the outlet 31 is generally submerged below the surface level of the reservoir 26. The slightly arcuate configuration of the wick maintains a uniform level of the reservoir across the length of the roller.

Figure 2:
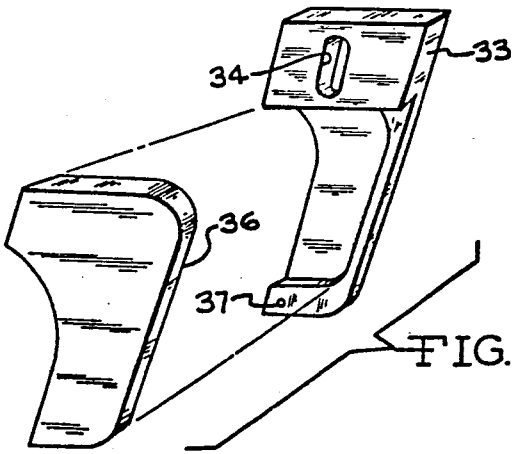
FIG. 2 is an overall pictorial view of the seal means of the present invention.
Figure 6:
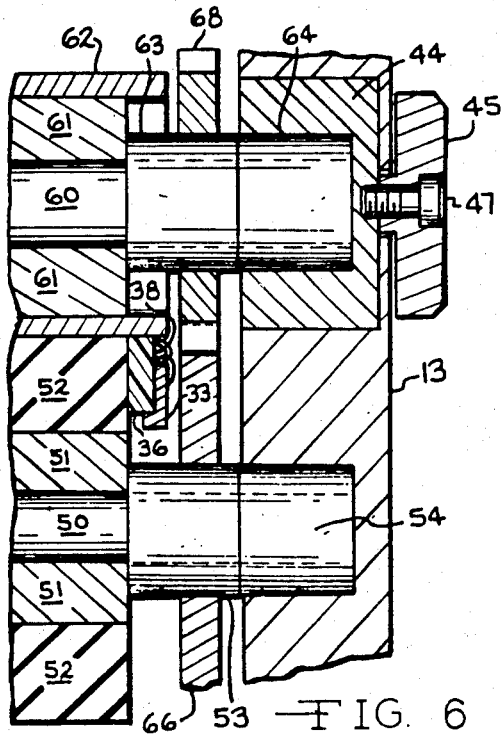
FIG. 6 is a sectional view along line 6—6 in FIG. 4.
Figure 7:
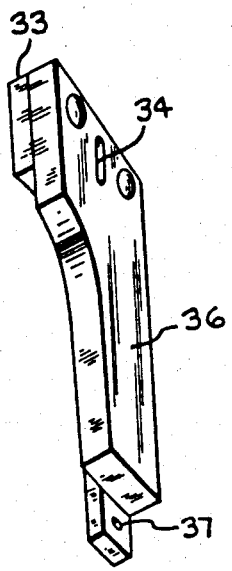
FIG. 7 is an overall pictorial view of an alternate seal means.

FIGS. 2 and 7 illustrate seal means used to prevent solution leakage from the reservoir. FIGS. 1, 3 5 and 6 depict the position of the seal means or dams in the dampening apparatus. The seal means comprises a seal carrier 33 and a seal plate 36. The seal carrier 33 is preferably metal while the seal plate 36 is preferably a plastic. The seal plate 36 forms both a circumferential seal with the metering roller 22 and an end seal with the form roller 20, as seen in FIG. 6.

Figure 3:
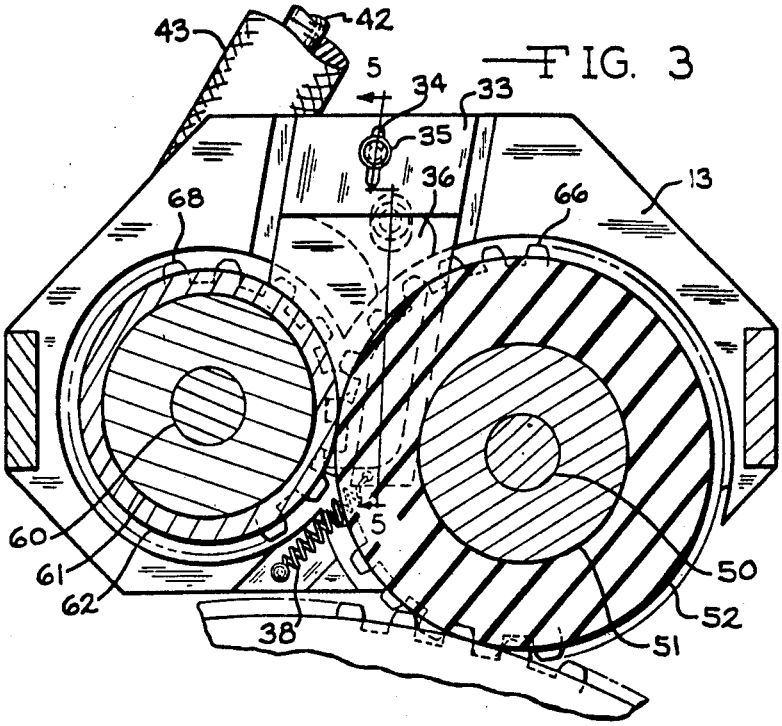
FIG. 3 is a sectional view along the line 3—3 in FIG. 1.
Figure 5:
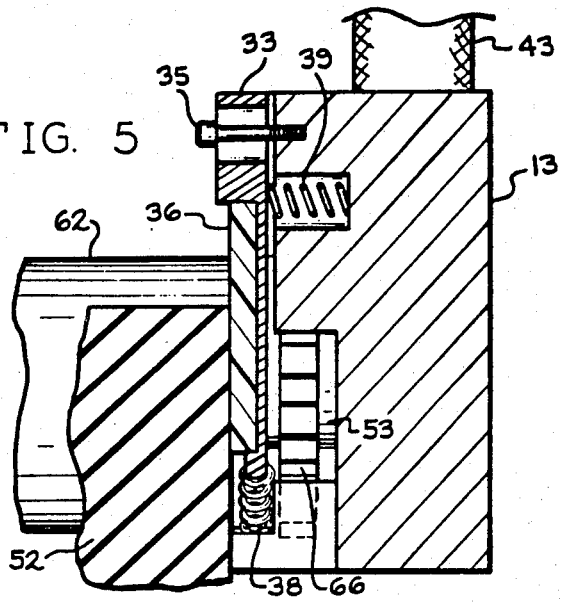
FIG. 5 is a sectional view along the line 5—5 in FIG. 3.

The seal means is affixed to the end housing 13 by a bolt 35 which extends through a slot 34 in the seal means as shown in FIGS. 1 and 5. A tension spring 38 is attached through an opening 37 in the seal carrier 33 as depicted in FIGS. 3 and 5. The opposing end of the spring 38 is secured to the end housing 13 (see FIG. 3). Another spring 39 is biased against the seal carrier 33 adjacent to the end housing 13 as illustrated in FIG. 5. The seal carrier 33 and therefore the seal plate 36 is urged downward and towards the metering roller 22 as a result of the tension in the spring 38. At the same time the spring 39 urges the seal carrier 33 and therefore the seal plate 36 against the end of the form roller 20. In this manner, the seal continues to be effective even while subjected to wear. As the metering roller 22 wears away the seal plate 36, the tension spring 38 assures a tight circumferential seal by pulling the seal plate 36 towards the metering roller 22. As the form roller 20 wears away the seal plate 36, spring 39 urges the seal against the end of the form roller 20 so that the end seal remains effective.

Figure 4:
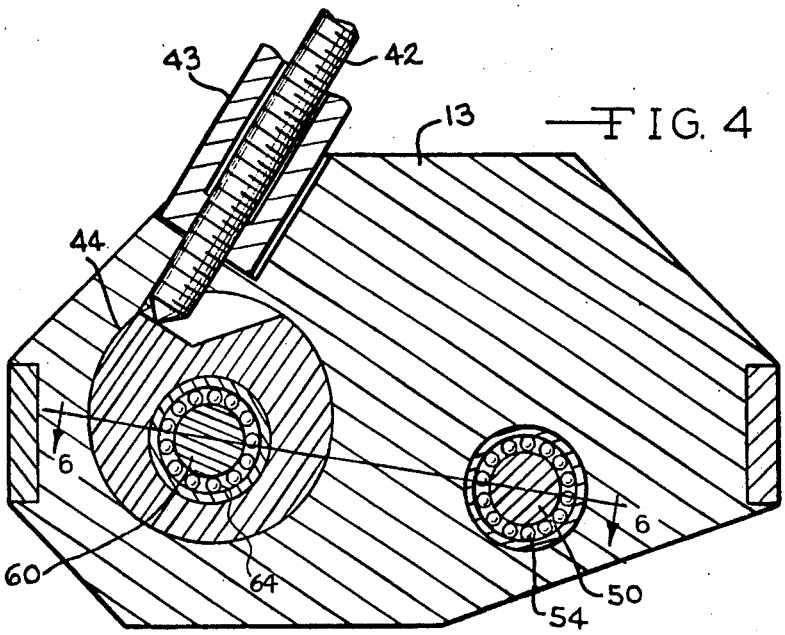
FIG. 4 is a sectional view along the line 4—4 in FIG. 1.

Adjustments to control the amount of pressure between the form roller 20 and the metering roller 22 are made by adjusting screws 42 at each end which are threaded through locknuts 43 (see FIG. 4). The screw 42 protrudes through the locknut 43 and the end housing 13 into a cam or eccentric 44. Adjusting the screw 42 causes the bearing of the second roller 22 to travel in a slightly eccentric arcuate path toward the form roller, and adjusting the screw in the opposite direction causes the second roller 22 to travel in a slightly eccentric arcuate path away from the form roller 20. Thus, the pressure between the two rollers is controlled, and the locknuts will hold the desired position.

The cam 44 is affixed to a roller pressure gauge or indicator 45 by a screw 47 as shown in FIG. 1. The gauge 45 protrudes from the end housing and is marked at predetermined intervals to give a relative reading of the pressure between the form roller and the second roller. An index mark 46 on the end housing 13 enables an observer reader to estimate the relative amount of pressure between the two rollers. The operator can loosen or tighten the screw 47 and adjust the position of the roller pressure gauge 45 at a zero point.

Referring to FIG. 6, the form roller 20 comprises a shaft 50 which is pressed inside a tubular body portion 51. A cylindrical shell 52 (e.g. of about 55 Durometer) is mounted over the tubular body portion 51. The shaft 50 extends beyond the roller 20 on both ends through an unidirectional clutch 53 into a bearing 54 which is mounted into the end housing 13.

The metering roller 22 comprises a shaft 60 which is pressed inside a tubular body portion 61. The tubular body portion 61 is pressed into a cylindrical shell 62. The shaft 60 extends from both ends of the roller. On the gear side of the dampener, the shaft 60 extends through an unidirectional clutch 63 and into a bearing 64 which is fitted into the cam 44. The opposing end of the shaft extends through a spacer (not shown) and is mounted in a like bearing in the end housing 13.

A gear 66 fits over and is fixed to the clutch 53 and is in meshing engagement with the drive gear 11. A second gear 68 fits over the central portion of the unidirectional clutch 63 and is in meshing engagement with the first driven gear 66. With this assembly the, the drive gear 11 drives the first driven gear 66, and the first driven gear 66 consequently turns the second driven gear 68. As the second driven gear 68 is press fit or otherwise fixed to the clutch 63, the turning of the gear 68 causes the clutch to engage, thereby resulting in rotation of the metering roller 22. Further, the form roller 20 is aided in its rotation by its contact with the complementarily revolving plate cylinder 10. The gear drive to the metering roller is optional; it is possible to drive the metering roller through frictional contact with the form roller due to the substantial pressure forcing them into contact. In any event, the form and metering rollers rotate at the same surface speed; there is no slip between them.

When the gears 66 and 68 are rotated in the opposite direction, the unidirectional clutches 53 and 63 disengage and both rollers 20 and 22 are prevented from rotating, to avoid dislodging the seals. The degree of preselected pressure between the rollers, 20 and 22, also determines the amount of solution which is metered from the reservoir 26 to the form roller 20. Similarly, the degree of pressure between the form roller 20 and the plate cylinder 10 determines the amount of the metered solution actually applied to the printing plate 85.

Figure 11:
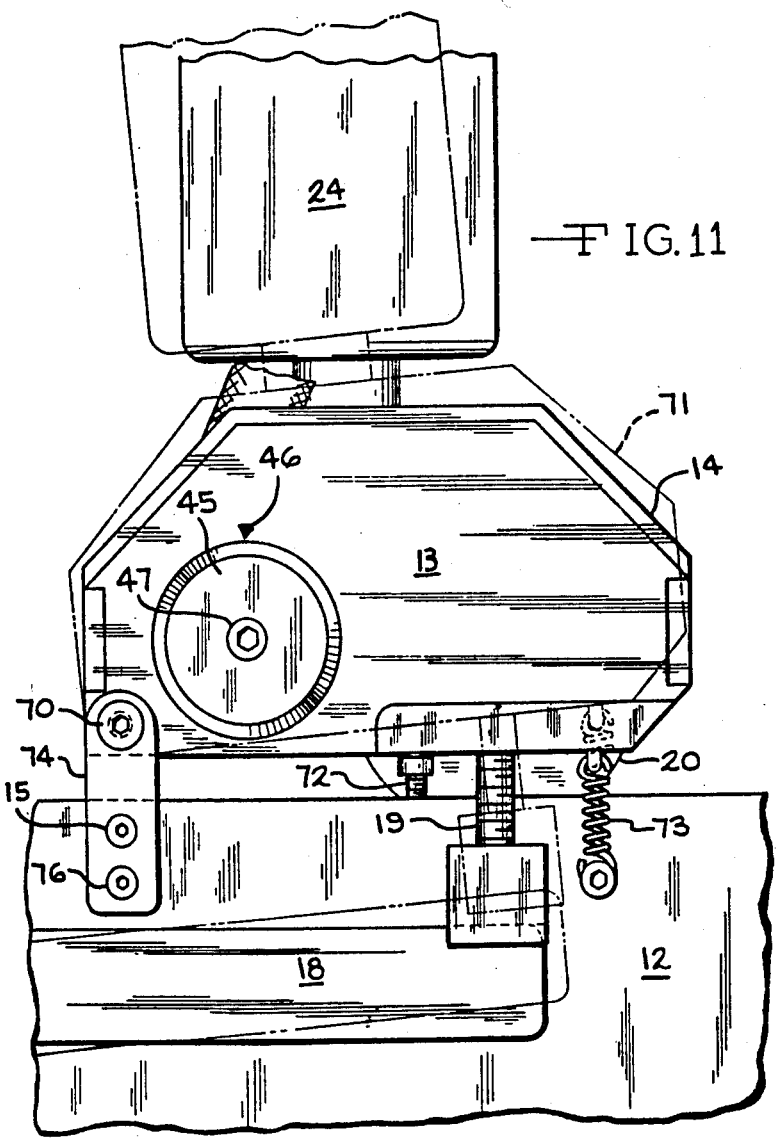
FIG. 11 is an end view of the embodiment in FIG. 1, illustrating the dampening apparatus mounting.

FIG. 11 illustrates the mounting or attachment between the dampening solution apparatus and the press. The dampening solution apparatus can be pivotally raised and lowered about a screw 70, as shown by phantom lines 71, by means of a lever arm 18 connected to the dampener housing 13 via a stud 19. The housing 13 is biased to the lowered position against an adjustment bolt 72 by a tension spring 73. Adjustment of the bolt 72 and selection of the spring 73 varies the degree of pressure between the plate cylinder 10 and the form roller 20. The screw 70 is supported in a connecting arm 74, which is secured to the press frame by two screws 75 and 76.

The relative rotation of the form roller 20, metering roller 22, and plate cylinder 20 are shown pictorially in FIG. 12. Due to the contact pressures, and the gear drive between the plate cylinder and the form roller, these three rotate at the same surface speed. A printing plate 85 is wrapped around the plate cylinder 10 and secured at the recessed section or gap 86. Subsequent to the dampening system, ink is applied to the plate 85 by means of a conventional train of ink rollers (not shown). In FIG. 12, the ink rollers would be located on the right side of the plate cylinders 10. After the ink is applied to the plate 85, the image thereby created is transferred to a blanket on cylinder 87 and then to the paper 88.

Application of a proper amount of dampening solution to the printing plate 85 is critical to the appearance of the printed image. Therefore, in theory, the pressure between the form and metering rollers, 20 and 22, should be adjusted to meter through to the form roller 20 only an amount which is to be applied to the plate 85, and the pressure between the form roller 20 and plate cylinder 10 should be precisely adjusted to apply that amount to the plate 85. In practice, such precise adjustment is impossible and constant monitoring is necessary.

With the present invention, ink is quickly carried back to rollers 20 and 22, and into the solution in the reservoir, upon starting of a printing operation. The ink-solution emulsion which results is milled under pressure between the form and metering rollers, apparently breaking this emulsion into small substantially uniform droplets, which produce a precisely inked image on the plate after only a few revolutions of the cylinder. There is little waste of paper during makeready, and good product is quickly available. Little adjustment of the metering roller/form roller/plate contact is needed from one job to another. A slight excess of liquid is metered through the line of tangency 27 between the form and second rollers, 20 and 22. The form roller 20 and plate cylinder 10 are precisely adjusted, however, to apply only a proper amount of solution to the plate 85. Some of the excess remains on the form roller surface as an ink-solution mixture and is continuously returned to the reservoir 26, while in the plate form roller nip a small pool 90 is created by the remainder of the excess, where the form roller 20 contacts the plate cylinder 10 as shown in FIG. 14.

The pool 90, however, is returned to the reservoir 26 upon each passage of the gap 86, as shown in FIG. 14. Since the reservoir 26 is located adjacent the form roller 20, but beyond the uppermost tangent 92 thereof in the direction of rotation, no occasion is presented for the dampening solution to collect where it can drip back to the plate 85. Thus, the present invention provides a means for continuously applying a uniform amount of solution to the plate 85 without the necessity of careful surveillance and administration by an operator.

Another advantage of the present invention is illustrated by FIG. 15. Each printing plate 85 necessarily includes heavily inked areas 95 and lesser inked areas 96, depending upon the intensity of the image to be finally created. Consequently, after some usage the form roller 20 and the metering roller 22 (usually to a lesser extent) will have corresponding heavily and lightly inked areas, 97 and 98. This is advantageous in that the amount of dampening solution actually applied to any particular portion of the plate 85 by the form roller 20 is roughly inversely proportional to the density of the ink on the corresponding portion of the form and metering rollers, 20 and 22. For example, the heavily inked areas 97 of the form roller 20 will actually apply less dampening solution to the corresponding heavily inked areas 95 on the printing plate 85, as compared to the amount of solution applied by the lightly inked areas 98. This is a desirable result since, as discussed in the background above, the heavier image areas 95 require less dampening solution to achieve clarity and definition.

As mentioned, prior art form rollers generally include highly absorbent covers, such as mulleton covers, in order to conduct a sufficient amount of dampening solution, and those covers quickly become fouled with ink to the point where the covers impair the image on the printing plate with too low a dampening solution rate. The operator must then replace the fouled cover with a new one, a timely and inefficient procedure. Similarly, the operator must change the cover when switching to a printing plate with an image of a different color.

With the present invention, since an ample supply of dampening solution is provided adjacent the form roller 20 and the nip between the form and metering rollers, 20 and 22, such absorbent covers are unnecessary and not used. It is preferred that the shells, 52 and 62, of the form and metering rollers, 20 and 22, be manufactured from rubber (55 Durometer) and metal or hard surface (copper or 100 Durometer elbonite-hard rubber), respectively. Other materials though will be apparent to the artisan.

Without the absorbent covers then (in fact, it is preferred that no part of the dampening apparatus be comprised of ink absorbent material), the ink which adhers to the rollers, 20 and 22, is merely on the surface thereof and is continuously exchanged with ink on the printing plate. Thus during operation of the press, the ink on the dampening rollers 20 and 22 does not build up excessively. Furthermore when a new printing plate is mounted on the plate cylinder, after a short period of operation the ink on the heavily inked areas, 97 and 98, of the form and metering rollers, 20 and 22, will be completely removed, and newly inked areas will appear on the rollers 20 and 22, corresponding with the new heavily inked areas on the new plate. Thusly, no down time is needed to replace covers.

Figure 16:
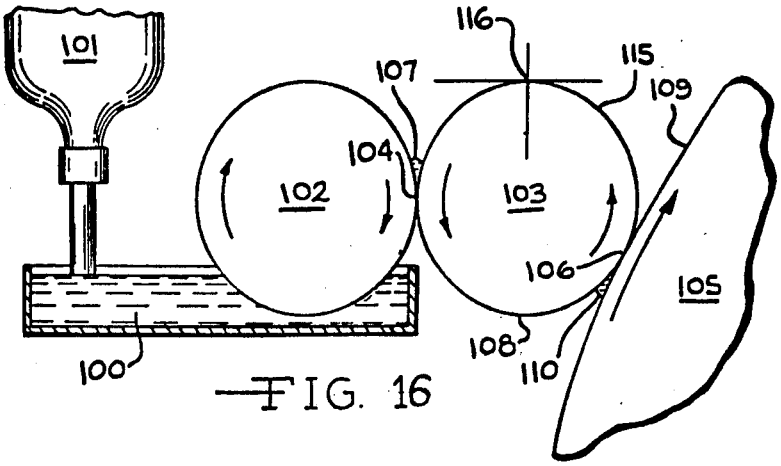
FIG. 16 is an end view schematic of another embodiment of a dampening apparatus in accordance with the present invention.
Figure 17:
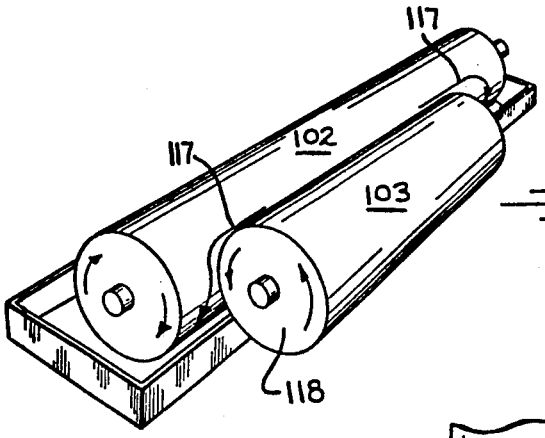
FIG. 17 is a pictorial view of the dampening rollers and reservoir in FIG. 16.
Figure 8:
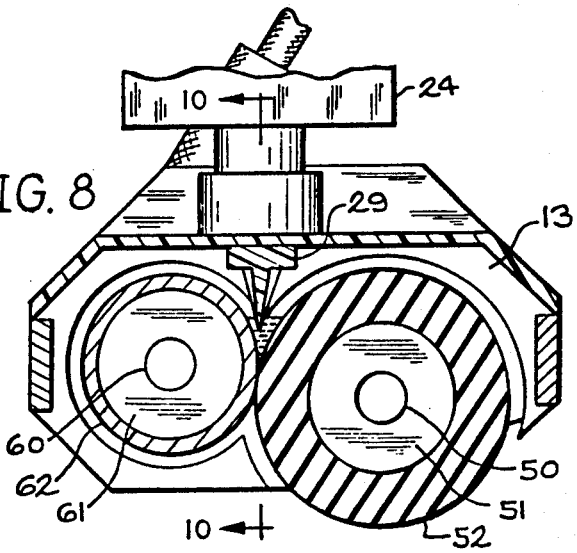
FIG. 8 is a sectional view along line 8—8 in FIG. 1.

An alternate embodiment of the dampening apparatus is illustrated in FIGS. 16 and 17. In those figures, the apparatus includes a pan 100, a solution fountain bottle 101, a metering roller 102 lying parallel and tangent to a form roller 103 at a line of tangency 104, and a form roller 103 lying parallel and tangent to a plate cylinder 105 at a line of tangency 106. The metering roller 102 lies within the pan 100 and rotates so as to continuously provide dampening solution to a supply 107 lying between the rollers 103 and 102, and above the line of tangency 104. Pressure between the rollers is adjusted to meter a slightly excessive quantity of solution from the supply 107 to the solution delivery arc 108 of the form roller 103, defined between the line of tangency 104 and the line of tangency 106 in the direction of rotation. Pressure between the form roller 103 and the plate cylinder 105 is adjusted to apply a proper amount of the above described excessive quantity to the printing plate 109, such that the excess 110 nipped by the form roller 103 and plate cylinder 105 is returned by the solution return arc 115 of the form roller 103, defined between the line of tangency 106 and the line of tangency 104 in the direction of rotation. The line of tangency 104 and supply 107 are located beyond the uppermost tangent 116 of the form roller 103 in the direction of rotation. As solution in the pan 100 is used, it is continually replaced by solution in the fountain bottle 101, as described above.

The form roller 103 may be is slightly shorter than the metering roller 102, in which case solution is regularly returned from the supply 107 to the pan 100 along the paths indicated by the arrows 117 as the supply 107 builds up to an overflowing level.

Figure 18:
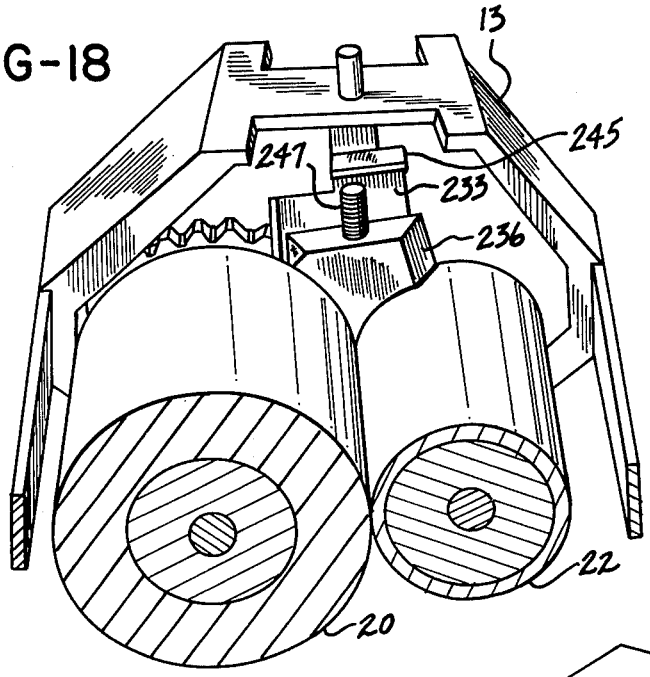
FIGS. 18 and 19 show a further embodiment of end seal and carrier for closing the ends of the reservoir between the form roller and metering roller.
Figure 19:
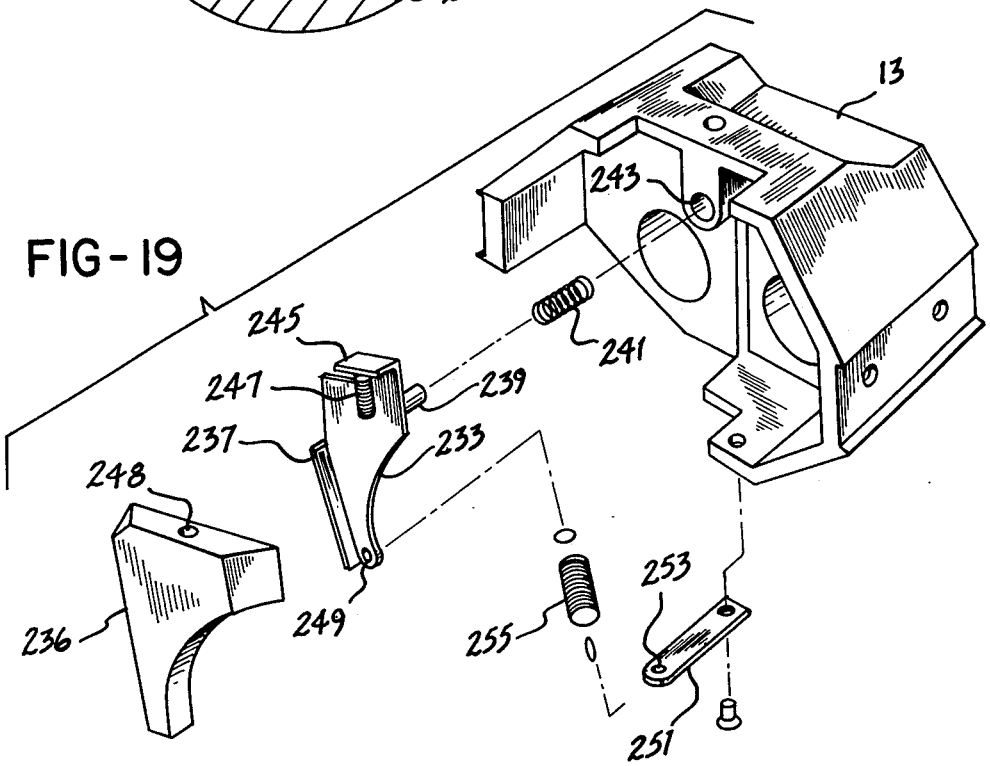

FIGS. 18 and 19 show another embodimebt of a seal means used to define the ends of the reservoir as shown in FIG. 1. The seal means comprises a seal carrier 233 and a seal member 236. A flange or lip 237 extends along one edge of the carrier, and the seal member 236 is free to move or float on the carrier 233, except that the lip 237 engages one side of the seal for retaining the seal member in relative position on the carrier 233. A hollow pin-like projection 239 extends from the surface of the carrier 233 that is opposite to the seal member 236. A spring 241 is positioned within the projection 239 and acts to bias the seal carrier 233 towards the form roller 20 and metering roller 22. The projection 239 and spring 241 extend into a blind hole 243 located in the end housing 13, thus the projection 239 in the aperture 243 maintains the seal carrier 233 in the proper end relationship with respect to the form roller 20 and defines a pivot axis for the seal means toward and away from the end periphery of metering roller 22.

On the top of the seal carrier 233 there is a flange 245 that projects over the top of the seal member 236, and spring 247 acts between the flange 245 and a bore 248 located in the upper surface of the seal member 236.

In the lower end of the seal carrier 233 there is an aperture 249. An arm 251 is positioned on the end housing 13 extending towards the form roller 20, and an aperture 253 is located in the end of the arm spaced apart from the end housing 13. A spring 255 is connected between the apertures 249 and 253 and the arm 251 extends inward beyond the carrier such that spring 255 will exert a force component that will bias the seal carrier towards the form roller 20, in addition to pulling the carrier toward the peripheral end of the metering roller.

In operation the seal 236 is essentially free to float on the seal carrier 233 during the operation of the dampening apparatus. The spring 241 will bias the seal means toward form roller 20 and the metering roller 22. The spring 247 will urge the seal downward into the nip between the cylindrical surfaces of the form roller 20 and the metering roller 22. Spring 255 pulls the seal carrier 233 and seal 236 towards the metering roller and specifically toward the metering roller 22 and toward the end of the form roller, as described. Thus the seal means is self adjusting and continuously provides a tight seal defining the ends of the dampening solution reservoir during the operation of the dampening apparatus.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A dampening apparatus for lithographic printing presses having a plate cylinder around which an offset lithographic printing plate may be mounted, a dampening form roller having an ink receptive surface and mounted parallel and contiguous to said plate cylinder along a first line of tangency, means for positively rotating said form roller in a direction counter to and at the same surface speed as said plate cylinder, a metering roller also having an ink receptive surface extending along a second line of tangency to said form roller on the opposite side thereof from said plate cylinder, the surface of said metering roller being substantially harder than the surface of said form roller, means for rotating said metering roller counter to and at the same surface speed as said form roller, means pressing said metering roller against said form roller and means pressing said form roller against a plate on said plate cylinder such that said rollers define between them a reservoir for dampening solution to which is added ink carried back to said rollers from the plate, whereby there exists a delivery arc on said form roller from said second to said first line of tangency measured in the direction of rotation of said form roller and an uninterrupted solution return arc on said form roller from said first to said second line of tangency in the direction of rotation of said form roller for the mixed ink and dampening solution, and a supply of dampening solution to said reservoir including means for automatically maintaining constant the dampening solution level in said reservoir.

2. A dampening solution feed apparatus, as defined in claim 1, further including seal means contacting adjacent ends of said form and metering rollers to define the ends of said reservoir.

3. A dampening solution feed apparatus, as defined in claim 2, wherein said seal means includes seal plates contacting the ends of said form roller and the adjacent periphery of said metering roller, and means urging said seal plates against each of said rollers.

4. A dampening apparatus, as defined in claim 1, wherein said supply of dampening solution includes a pan and means mounting said metering roller above and partially submerged within said pan and wherein said level maintaining means automatically maintains the level of solution constant in said pan, whereby rotation of said metering roller continuously carries the dampening solution from said pan to said reservoir.

5. A dampener for an offset lithographic printing press having a plate cylinder on which a lithographic plate can be mounted, said dampener comprising a frame adapted for mounting on the press adjacent the plate cylinder, a form roller rotatably supported in said frame for contact with a plate on the plate cylinder, a metering roller rotatably supported in said frame in pressure contact with said form roller and on the opposite side thereof from the plate cylinder, seal means mounted on said frame in cooperative relation with said rollers to define a reservoir for dampening solution, said form roller and said metering roller having ink receptive surfaces and the surface of said metering roller being substantially less resilient than the surface of said form roller, means for urging said form roller into contact with a plate on the plate cylinder, means urging said metering roller into contact with said form roller with a force sufficient to compress the form roller surface, drive means rotating said rollers at one-to-one surface speed with each other and with the plate cylinder, and means providing a supply of dampening solution to said reservoir, whereby solution in said reservoir is continually mixed with ink picked up from the plate by the action of the metering and form rollers and the resulting emulsion of solution and ink is applied to the plate by said form roller, the density of ink in the emulsion being directly related to the density of image areas on the plate.

6. A dampener as defined in claim 5, wherein said seal means comprises:

seal carriers movably supported on said frame adjacent the ends of said first and second rollers said carriers having a seal contacting surface;

a seal member contained in each of said seal carriers;

means biasing said seal carriers toward the end of said form roller and toward the circumferential surface at the end of said metering roller, whereby a circumferential seal is formed against the periphery of said metering roller and an end seal is formed against said form roller.

7. The dampener defined in claim 6, including pin members extending between said seal carriers and the ends of said frame to define an axis about which said carriers can pivot and also move axially.

8. The dampener defined in claim 7, including a resilient member acting on each of said pin members to bias each of said seal carriers towards the end of said first roller.

9. The dampener defined in claim 8, including spring members connected between said carriers and said frame and acting to bias said seal members towards the circumferential surface of said metering roller.

10. A dampener as defined in claim 5, wherein the dampening solution supply is a bottle including a neck through which the solution is discharged, a valve associated with said neck to control flow of solution out of said bottle, and means supporting said bottle and valve in inverted relation over the center of said reservoir, whereby solution is supplied to said reservoir and continually mixed with ink picked up from the plate by the rotating action of the metering and form rollers, the resulting emulsion of solution and ink being carried through the nip defined by said metering and form rollers to the plate by said form roller, and solution is added to the reservoir as the level of ink and solution emulsion lowers beneath said valve.

11. A dampener as defined in claim 10, including an elongated wick member extending from said valve parallel to but spaced from said rollers, said wick member extending essentially between said seal means and projecting downward toward the nip whereby solution being added from the bottle is distributed along the length of said reservoir.

12. A dampener as defined in claim 10 wherein said valve includes a movable plunger and a passageway for allowing air to pass into said bottle when the level in said reservoir lowers away from said valve.

13. A dampener as defined in claim 12 wherein said air passageway extends through said plunger and terminates in an opening in the side of said plunger, said opening communicating with the interior of said bottle.

14. A dampener as defined in claim 13, including a further passageway around the exterior of said plunger to allow solution to pass from said bottle, said plunger containing a seal member that seats within said valve to close said air passageway and said solution passageway, and a spring positioned around said plunger to bias said seal member into seating engagement with said valve when said bottle is not in position above said reservoir whereby flow of solution from said bottle is prevented, said plunger being displaced from seating engagement with said valve when said bottle is positioned above said reservoir.

* * * * *